US006775497B2

(12) United States Patent
Sugimura et al.

(10) Patent No.: US 6,775,497 B2
(45) Date of Patent: Aug. 10, 2004

(54) ELECTROPHOTOGRAPHIC PHOTOSENSITIVE BODY WITH HOLLOW BASE AND FILLER ELEMENT, ELECTROPHOTOGRAPHIC APPARATUS USING SAME

(75) Inventors: Hiroshi Sugimura, Habikino (JP); Koichi Toriyama, Yao (JP); Mikio Kakui, Ikoma-gun (JP); Rikiya Matsuo, Nara (JP); Hisayuki Utsumi, Yamatokorlyama (JP); Masanori Matsumoto, Kashihara (JP); Masayuki Sakamoto, Nabari (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/397,241

(22) Filed: Mar. 27, 2003

(65) Prior Publication Data

US 2003/0198483 A1 Oct. 23, 2003

(30) Foreign Application Priority Data

Apr. 23, 2002 (JP) ..... 2002-120569

(51) Int. Cl.[7] ..... G03G 15/00
(52) U.S. Cl. ..... 399/159
(58) Field of Search ..... 399/159, 91; 430/69; 181/196, 208

(56) References Cited

U.S. PATENT DOCUMENTS 5,960,236 A * 9/1999 Zaman et al. ..... 399/91

FOREIGN PATENT DOCUMENTS

| | | | | |
|---|---|---|---|---|
| JP | 62-127567 U | | 8/1987 | |
| JP | 63-060481 A | | 3/1988 | |
| JP | 63-271388 A | | 11/1988 | |
| JP | 02-118684 A | | 5/1990 | |
| JP | 03-105348 A | | 5/1991 | |
| JP | 05-035166 A | | 2/1993 | |
| JP | 08-062878 A | | 3/1996 | |
| JP | 08-146636 A | | 6/1996 | |
| JP | 08-146637 A | | 6/1996 | |
| JP | 10-097158 A | * | 4/1998 | ..... G03G/21/00 |
| JP | 11-305598 A | | 11/1999 | |
| JP | 2000-089612 | | 3/2000 | |

* cited by examiner

*Primary Examiner*—Arthur T. Grimley
*Assistant Examiner*—Ryan Gleitz
(74) *Attorney, Agent, or Firm*—Nixon & Vanderhye P.C.

(57) ABSTRACT

In the present invention, a filler element 20 formed of a viscoelastic material with a compressive residual strain of 10% or less and a 25% compressive load of 1 kg/cm$^2$, having a specific shape, is mounted in a drum-shaped electrophotographic photosensitive body (photosensitive drum) 10. The filler element 20 has a sufficient restoring force when deformed, so that it can be fixed to position without an adhesive. Also, the filler element 20 is not moved by vibration or shock during repeated use, and good anti-vibration effect can be maintained.

8 Claims, 3 Drawing Sheets

ELECTROPHOTOGRAPHIC PHOTOSENSITIVE BODY WITH HOLLOW BASE AND FILLER ELEMENT, ELECTROPHOTOGRAPHIC APPARATUS USING SAME

BACKGROUND OF THE INVENTION

The present invention relates to an electrophotographic photosensitive body capable of suppressing or preventing the generation of vibration noise during the use, an electrophotographic process cartridge using the same, and an electrophotographic apparatus.

DESCRIPTION OF THE RELATED ART

An electrophotographic photosensitive drum used for an electrophotographic apparatus or the like is generally manufactured by applying a photosensitive layer etc. on the surface of a metallic, hollow cylindrical base formed of aluminum and the like. Such an electrophotographic photosensitive drum, which is used for an electrophotographic copying machine or a laser printer, sometimes produces various kinds of vibration noise according to operating conditions. For example, it is mentioned in Japanese Patent Laid-Open No. 2-118684 and Japanese Patent Registration Publication No. 2913689 that creaking noise is generated due to the contact of the electrophotographic photosensitive drum with a cleaning blade.

In order to prevent the generation of such noise, some filler element is inserted and fixed to the inside of the hollow cylindrical base of the electrophotographic photosensitive drum. The possible shapes of the filler element include a structure combined with a panel (see Japanese Utility Model Laid-Open No. 62-127567 and Japanese Patent Laid-Open No. 11-305598), a spiral shape (see Japanese Patent Laid-Open No. 8-62878), columnar shape (see Japanese Patent Laid-Open No. 2000-89612), and the like.

The possible materials for the filler element include a porous elastic member (see Japanese Patent Laid-Open No. 63-60481), a lapped member having specific JIS hardness (see Japanese Patent Laid-Open No. 5-35166), polyurethane foam (see Japanese Patent Laid-Open No. 63-271388), a viscoelastic material (see Japanese Patent No. 2913689), a filler element whose coefficient of linear expansion is specified (see Japanese Patent No. 3259554), and so on.

All of the above-described filler elements have an anti-vibration effect at the early stage of use. However, after repeated use, the member is shifted or displaced by the centrifugal force, vibrations, shock, or the like, so that the anti-vibration effect at the early stage can no longer be achieved.

To overcome this problem, the filler element is often fixed with an adhesive. In some cases, the hollow cylindrical base may be deformed by expansion and contraction depending on the kind of adhesive being used, and therefore an adhesive which prevents this deformation has been proposed (see Japanese Patent No. 3139669). However, the use of an adhesive requires the product to stand still until it is cured at the time of production, which takes much time, thereby decreasing the productivity. Also, the recent design that takes recycling into account entails a problem in that when the electrophotographic sensitive drum is disassembled, it is difficult to remove the bonded filler element.

The present invention has been made to solve the above problems of the prior art, and the object thereof is to provide an electrophotographic photosensitive body which is easily manufactured, has no deformation of a hollow cylindrical base and no decrease in anti-vibration effect when repeatedly used, and is equipped with a filler element which can be removed easily at the time of recycling. The present invention further provides a silent process cartridge using the above-mentioned photosensitive body, and an electrophotographic apparatus.

SUMMARY OF THE INVENTION

In the present invention, a filler element formed of a viscoelastic material having specific properties and a specific shape is mounted in a drum-shaped electrophotographic photosensitive body (photosensitive drum). As for the properties, a viscoelastic material with a compressive residual strain of 10% or less is used. The compressive residual strain was measured in accordance with JIS (Japanese Industrial Standards) K6401.

By using a filler element formed of a viscoelastic material with a compressive residual strain of 10% or less, the filler element has a sufficient restoring force when being deformed, so that it can be fixed to position without an adhesive. Also, the filler element is not moved by vibration or shock at the time of repeated use, and an anti-vibration effect can be maintained. If the compressive residual strain exceeds 10%, the filler element is not sufficiently fixed to the electrophotographic photosensitive drum because of weak restoring force, and the anti-vibration effect is decreased by repeated use.

Further, the filler element in accordance with the present invention has a construction using a viscoelastic material with a 25% compressive load of 1 kg/cm$^2$.

By this construction, the filler element is provided with a proper flexibility, so that the workability at the time of mounting the filler in the electrophotographic photosensitive drum and at the time of recycling the same is improved, by which the productivity is enhanced. If the 25% compressive load exceeds 1 kg/cm$^2$, the filler element becomes less deformable, so that the workability is degraded. The 25% compressive load was measured at a compression rate of 1 mm/min using a sample with a diameter of 50 mm in accordance with JIS K6301.

Preferably, the filler element has a plate-like body with a thickness of d mm, a length of a mm, and a width of b mm, and the shape satisfies the following expressions (1) to (4):

$$\Sigma a \leqq L \quad (1)$$

$$\pi r/2 \leqq b \quad (2)$$

$$d > 4 \quad (3)$$

$$r - 2d > 10 \quad (4)$$

where,

Σa: sum of lengths of inserted viscoelastic material;

L: length of hollow cylindrical base;

r: inside diameter of hollow cylindrical base.

By satisfying expression (1), the filler element in accordance with the present invention can be inserted without protruding from the hollow cylindrical base.

By satisfying expression (2), the filler element can be inserted easily, and after the insertion, the filler element is fixed and will not move.

By satisfying expression (3), the filler element is fixed without moving even if it is subjected to vibration or shock.

By satisfying expression (4), the workability for installing the filler element on an insertion device can be improved.

Since the filler element is fixed to the base by only the force generated by the restoration of the viscoelastic material without the use of an adhesive, at the time of recycling of the electrophotographic photosensitive drum, the filler element can be separated easily from the drum because there are no adhering residues. Also, since the filler elements in accordance with the present invention are inserted and fixed at positions symmetrical with respect to the center in the lengthwise direction of the cylinder, the stability during rotational drive is increased, and swaying due to irregular movement is restrained. Further, a foam is preferably used as the viscoelastic material, and in particular, the use of an urethane foam eliminates the frictional force with the back surface of the base and thus eliminates deterioration due to heat or temperature and humidity at the time of use.

In a process cartridge having a construction in which a cleaning blade is brought into contact with the photosensitive body or an electrophotographic apparatus in accordance with the present invention, the drum-shaped photosensitive body has an especially good anti-vibration effect to prevent vibrations generated when the cleaning blade comes into contact with and slides on the surface of the photosensitive body, so that a very quiet process cartridge or electrophotographic apparatus can be provided.

DETAILED DESCRIPTION OF THE PREFERRED EMBODIMENTS

Figure 1:
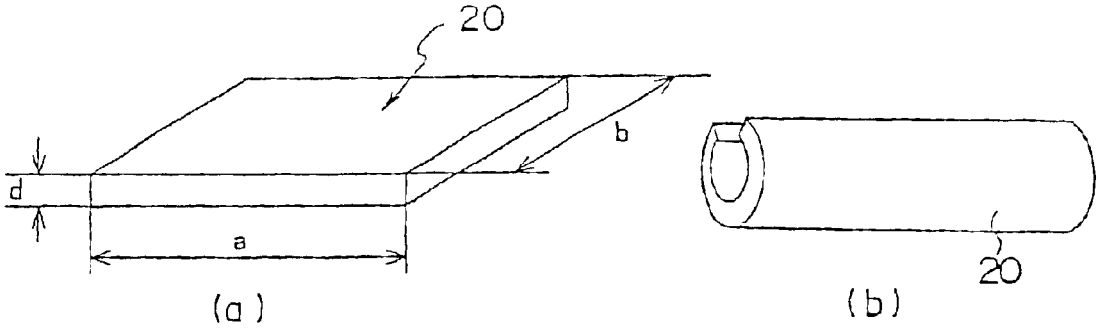
FIG. 1 is a perspective view of a filler element.
Figure 2:
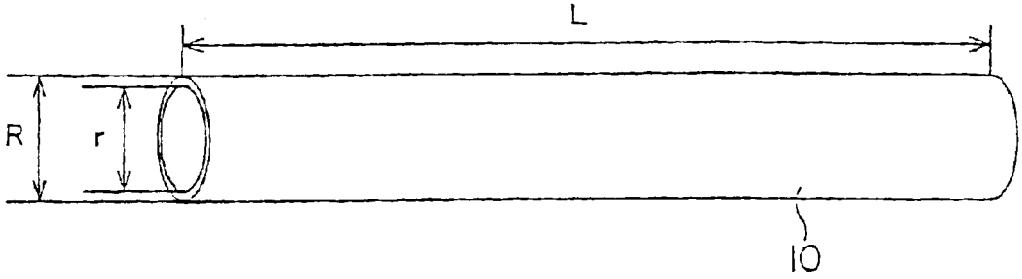
FIG. 2 is an explanatory view of a drum-shaped electrophotographic photosensitive body.
Figure 3:
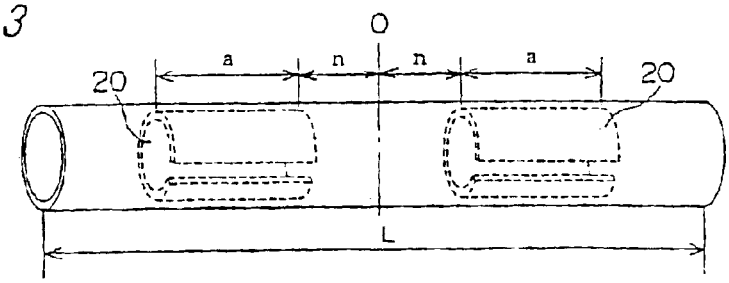
FIG. 3 is an explanatory view of a drum-shaped electrophotographic photosensitive body in accordance with the present invention.
Figure 4:
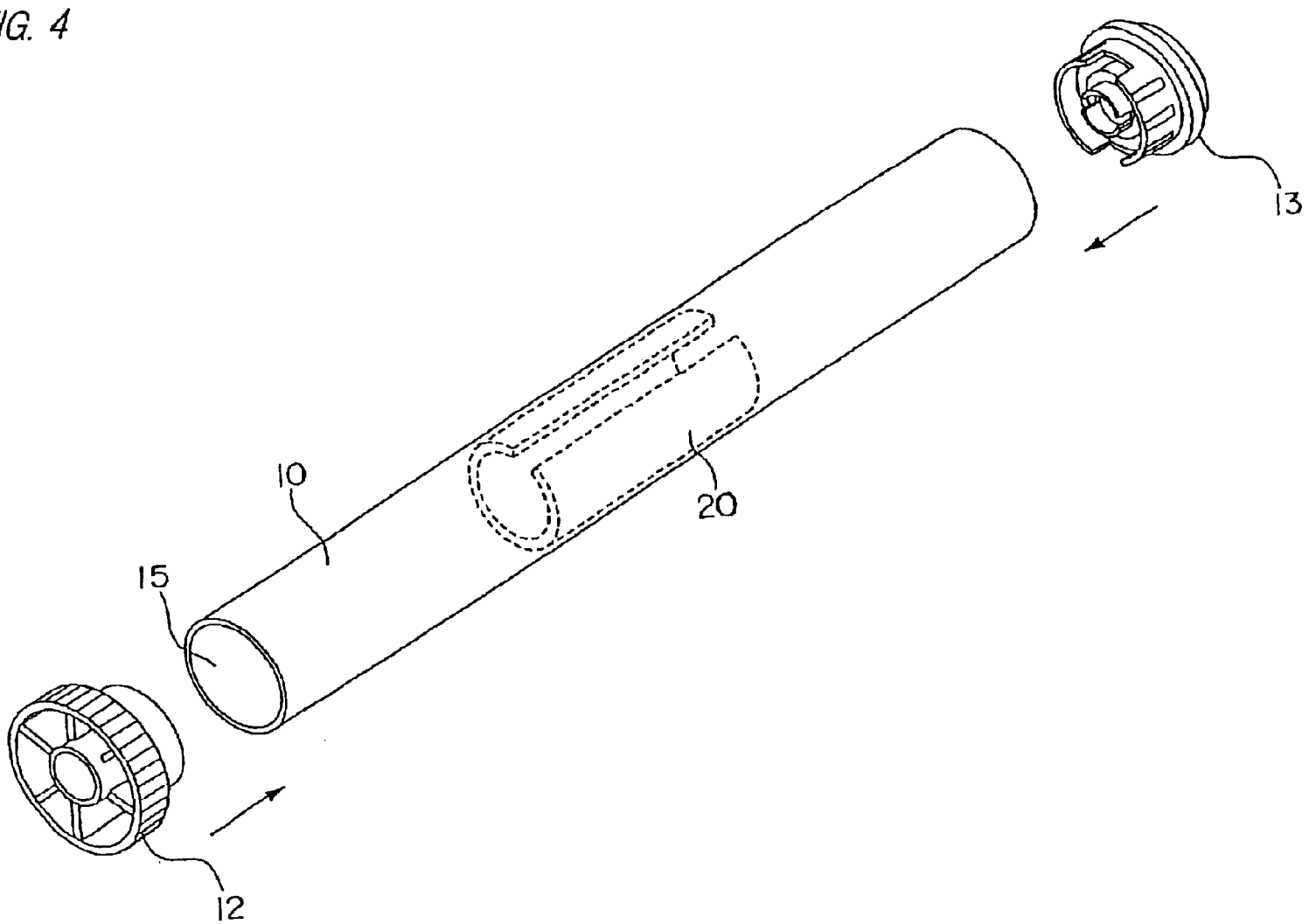
FIG. 4 is an explanatory view of an electrophotographic photosensitive drum.
Figure 5:
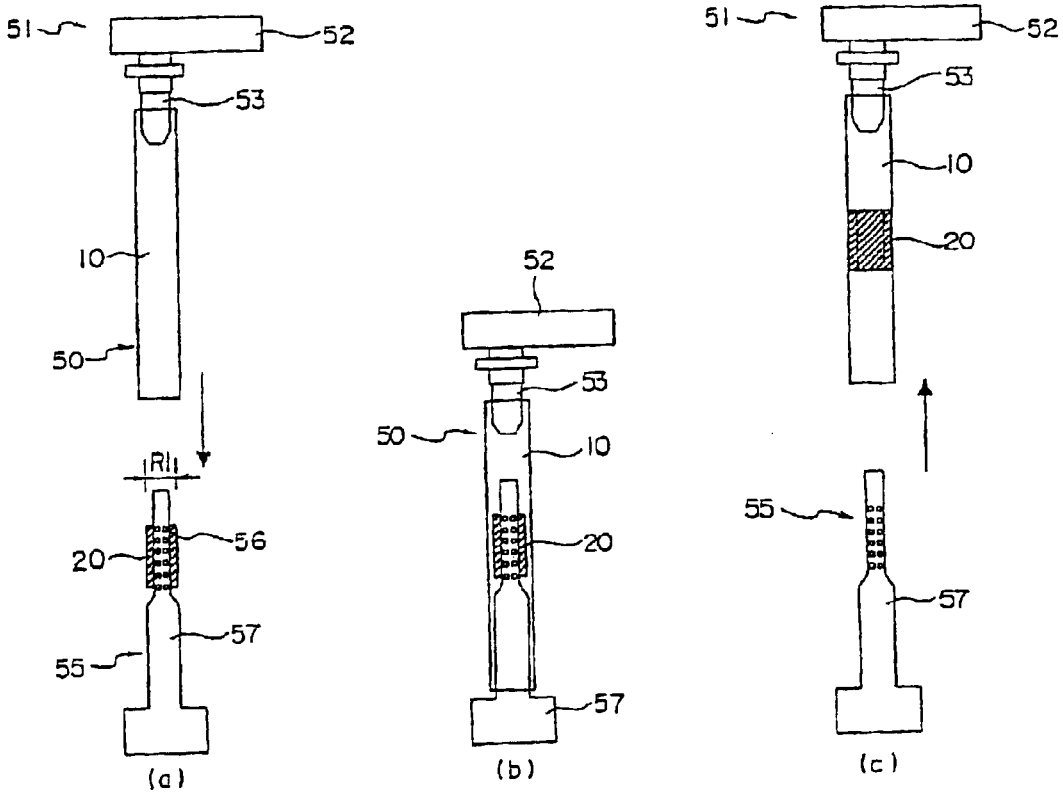
FIG. 5 is an explanatory view of a device for inserting a filler element.

An embodiment of the present invention will now be described in detail with reference to the accompanying drawings. FIG. 1 is an explanatory view of a filler element in accordance with the present invention, FIGS. 2 to 4 are explanatory views of a drum-shaped electrophotographic photosensitive body in accordance with the present invention, and FIG. 5 is a view showing an example of an insertion device for the photosensitive body.

The drum-shaped photosensitive body, which is constructed by providing a photosensitive layer on the surface of a hollow cylindrical base 10, uses a cylindrical conductive support formed of a metal such as aluminum, nickel, copper, iron, or zinc or an alloy of these metals as the hollow cylindrical base 10. The cylindrical base 10 preferably has an outside diameter R of 20 to 100 mm and a length L of 240 to 400 mm. When the inside diameter of the hollow cylindrical base 10 is taken as r, the thickness (R−r)/2 should preferably be 0.5 to 4 mm. Conventionally known members can be used to form flanges 12, 13 and the photosensitive layer.

A filler element 20 in accordance with the present invention is formed by a plate-shaped element formed of a viscoelastic material measuring a in length by b in width by d in thickness. Any viscoelastic material that has predetermined physical properties (compressive residual strain, 25% compressive load, etc.) can be used as a material for the filler element 20. For example, a foam made of a synthetic resin is preferable in terms of physical properties and economy. Polyolefin foam, polystyrene foam, polyurethane foam, polyvinyl chloride foam, fluoro rubber foam and the like having physical properties such as a compressive residual strain of 10% or less and a 25% compressive load of 1 $kg/cm^2$ can be used. In particular, polyurethane foam (urethane foam) is desirable because it is inexpensive and is suitable for obtaining the predetermined physical properties. Actually, as a high-density micro-cellular urethane foam, products such as Poron L-24, LE-20, L-32 (trademark) etc. manufactured by Rogers Inoac Corporation are used. This foam is cut into a predetermined size of (a×b) and used.

The plate-shaped filler element 20 is rounded into a cylindrical shape (see FIG. 1(*b*)), and is inserted to the cylindrical base 10. The filler element 20 is fixed by a force generated by the restoration of the filler element 20, having been deformed (rounded) from the plate shape, to the original shape. The method for insertion maybe manual or mechanical.

Here, a method for mechanically inserting the filler element is explained with reference to FIG. 5.

An insertion device 50 for inserting the filler element 20 into the cylindrical base 10 includes a holding member 51 for holding the cylindrical base 10 and a filler element attaching member 55 for attaching the filler element 20. In this embodiment, the holding member 51 can be moved.

The holding member 51 is constructed so as to have a support rod 52 projectingly provided with a protrusion 53 for fittingly holding the cylindrical base 10 and to be movable toward the filler element attaching member 55 as indicated by the arrow mark by a driving device not shown.

The filler element attaching member 55 has a locking portion 57 provided with a locking rod 56 for attaching the filler element 20.

First, the plate-shaped filler element 20 is wound on the locking portion 57 of the filler element attaching member 55, and is locked to the locking rod 56 by means of air suction. At this time, the outside diameter R1 of the filler element 20 is made slightly smaller than the inside diameter r of the cylindrical base 10.

Next, the cylindrical base 10 is fittingly held by the protrusion 53 of the holding member 51. Then, the support rod 52 is lowered, by which the filler element attaching member 55 that locks the filler element 20 is inserted into the cylindrical base 10. When the filler element 20 is positioned in the central portion of the cylindrical base 10, the air suction is halted to unlock the filler element 20 from the locking portion 57. At this time, the filler element 20 is fixed to the inside wall surface of the cylindrical base 10 by means of a force generated by the restoration of the filler element 20 to its plate shape.

The support rod 52 is raised, and then the cylindrical base 10 to which the filler element 20 is fixed in the central portion thereof is removed from the protrusion 53.

When two filler elements 20 are inserted as shown in FIG. 3, they are inserted and fixed at positions at an equal distance n from the center O of the cylindrical base 10.

As shown in FIG. 4, the flanges 12 and 13 are fittingly mounted in openings 15 at both ends of the cylindrical base 10. In the embodiment shown in FIG. 4, an example in which one filler element 20 is inserted in the cylindrical base 10 is shown. In this case, the filler element 20 is inserted and fixed in the central portion of the cylindrical base 10.

A plurality of filler elements may be inserted. In this case, the filler elements are inserted and fixed at positions symmetrical with respect to the center in the lengthwise direction of the cylindrical base 10.

EXAMPLES

Hereunder, the present invention will be described in further detail with reference to examples. It is a matter of course that the present invention is not limited to these examples.

Example 1

An electrophotographic photosensitive body was manufactured by applying a photosensitive layer consisting of an under coating layer, a charge developing layer, and a charge transporting layer on the surface of a cylindrical aluminum base with an outside diameter R of 30 mm, an inside diameter r of 28.4 mm, and a length L of 340 mm by the dip coating method and by drying the coated cylindrical base by heating.

As a filler element, a foam (Poron LE-20, trademark, manufactured by Rogers Inoac Corporation) with a compressive residual strain of 5.9% and a 25% compressive load of 0.2 kg/cm$^2$ was cut into a rectangular shape with a width b of 65 mm, a length a of 100 mm, and a thickness d of 5 mm. Two rectangular plates 20 were prepared.

The rectangular plates 20 were rounded into a cylindrical shape, and inserted into the electrophotographic sensitive drum along the inside wall surface of the cylindrical aluminum base from both sides. Then, as shown in FIG. 3, the rounded filler elements 20 were fixed at positions symmetrical with respect to the center (line O) of the cylindrical aluminum base (at an equal distance n).

At this time, the filler element 20 consisting of a foam was easily deformed into a cylindrical shape, and the workability for insertion was good. After insertion, the filler element 20 was fixed onto the inside surface of the base by the restoring force of the viscoelastic material itself so as not to be moved by movement and vibrations. After flanges 12 and 13 were mounted on both sides of the photosensitive body 10, the photosensitive body 10 was fixed to a process cartridge having a cleaning blade. The process cartridge was mounted on a commercially available copying machine (AR45OM, trademark, manufactured by Sharp Corporation) to repeat copying.

The abnormal noise generated at that time was examined, but abnormal noise was not generated when the electrophotographic photosensitive drum begins to rotate and stops, and hence the copying machine was quiet. Even after copying was performed on 300 thousand A4-size papers, abnormal noise was not generated. After use, the process cartridge was taken out of the copying machine, and the flanges were removed from the electrophotographic photosensitive drum. The inside of the hollow cylindrical photosensitive body was observed, and it was found that the incorporated filler elements were fixed at their original positions. Also, the filler elements taken out of the photosensitive body had no fusion caused by the deterioration of material. Further, there were no residues on the inside surface of the hollow cylindrical photosensitive body.

Example 2

A sample was manufactured and evaluated in the same way as in example 1 except that Poron L-24 (trademark), manufactured by Rogers Inoac Corporation, with a compressive residual strain of 2.7% and a 25% compressive load of 0.4 kg/cm$^2$ was used as the filler elements.

After repeated use, the copying machine was quiet and abnormal noise could not be observed. As in the case of example 1, the inside wall surface of the photosensitive body was checked after the use, but deterioration was not found.

Example 3

A sample was manufactured and evaluated in the same way as in example 1 except that Poron FH-48 (trademark), manufactured by Rogers Inoac Corporation, with a compressive residual strain of 7.0% and a 25% compressive load of 7.3 kg/cm$^2$ was used as the filler elements.

The workability for insertion was poor because the filler element was hard, but the copying machine was quiet and no abnormal noise was generated even after repeated use. The anti-vibration effect was not affected. As in the case of example 1, the inside wall of the photosensitive body was observed after use, but deterioration was not found. However, the workability for removal of filler element was poor because the filler element was hard.

Example 4

A sample was manufactured and evaluated in the same way as in example 1 except that the thickness d of the filler element was 3 mm.

Abnormal noise was not generated during normal use, but the photosensitive body was vulnerable to strong shock caused during transportation and movement of the copying machine, and abnormal noise was generated at the start and end of rotation. After the use, the inside of the body was observed, and it was found that the filler element was separated from the inside surface of the electrophotographic photosensitive drum.

Example 5

A sample was manufactured and evaluated in the same way as in example 1 except that the width b of the filler element was 40 mm.

Abnormal noise was not generated at the early stage, but the photosensitive body was vulnerable to strong shock caused during transportation and movement of the copying machine, and abnormal noise was generated at the start and end of rotation. After the use, the inside of the body was observed, and it was found that a gap was formed between the filler element and the inside surface of the base in the electrophotographic photosensitive drum.

Example 6

A sample was manufactured and evaluated in the same way as in example 1 except that the thickness d of the filler element was 10 mm.

An attempt was made to insert the filler element by using the insertion device shown in FIG. 5, but the insertion was impossible. The filler element was inserted manually and evaluation was made, with the result that the anti-vibration effect had no problem.

Comparative example 1

A sample was manufactured and evaluated in the same way as in example 1 except that no filler element was inserted. From the early stage, abnormal noise was generated at the time of start and stop of rotation of the electrophotographic photosensitive drum.

Comparative example 2

A sample was manufactured and evaluated in the same way as in example 1 except that PE foam with a compressive residual strain of 45% and a 25% compressive load of 0.4 kg/cm$^2$ was used as the filler elements.

The specimens in the base moved during the repeated use, and abnormal noise was generated each time the rotation of the electrophotographic photosensitive drum was stopped.

As described above, by incorporating a viscoelastic material with a compressive residual strain of 10% or less in the electrophotographic photosensitive body, abnormal noise is prevented from being generated at the time of use, by which the body maintains quietness even after repeated use. Also, by making the 25% compressive load 1 kg/cm$^2$ or lower, the workability related to mounting the filler element into and demounting the same from the electrophotographic photosensitive drum is improved, by which the productivity is increased.

Also, a specific shape of the filler element is selected to improve the anti-vibration effect and to maintain the same effect for a long period of time. Further, the filler element can be fixed onto the inside surface of the base by a force generated by the restoration of the viscoelastic material itself, which improves the workability at the time of recycling. By arranging the filler elements at positions symmetrical with respect to the center in the lengthwise direction of the drum, deflection of rotation of the electrophotographic photosensitive drum can be prevented. The filler element in accordance with the present invention remarkably prevents abnormal noise generated between the electrophotographic photosensitive body and the cleaning blade, which facilitates the design of process cartridge and electrophotographic apparatus.

What is claimed is:

1. An electrophotographic photosensitive body comprising a photosensitive layer on the surface of a hollow cylindrical base, wherein said hollow cylindrical base incorporates a filler element formed of a viscoelastic material with a compressive residual strain of 10% or less; and said viscoelastic material is plate-shaped with a thickness of d mm, a length of a mm, and a width of b mm, and said shape satisfies the following expressions (1) to (4):

$$\Sigma a \leq L \quad (1)$$

$$\pi r/2 \leq b \quad (2)$$

$$d > 4 \quad (3)$$

$$r - 2d > 10 \quad (4)$$

where,

Σa: sum of lengths of inserted viscoelastic material;

L: length of hollow cylindrical base;

r: inside diameter of hollow cylindrical base.

2. The electrophotographic photosensitive body according to claim 1, wherein said viscoelastic material has a 25% compressive load of 1 kg/cm$^2$ or lower.

3. The electrophotographic photosensitive body according to claim 1, wherein said filler element is deformed and inserted in said hollow cylindrical base, and is held by and fixed to said base by only a force generated by the restoration of said viscoelastic material.

4. The electrophotographic photosensitive body according to claim 1, wherein said filler elements are inserted and fixed at positions symmetrical with respect to the center in the lengthwise direction of said hollow cylindrical base.

5. The electrophotographic photosensitive body according to claim 1, wherein said viscoelastic material comprises foam.

6. The electrophotographic photosensitive body according to claim 5, wherein said foam comprises urethane foam.

7. An electrophotographic process cartridge comprising at least an electrophotographic photosensitive body and a cleaning member which comes into contact with the surface of said photosensitive body, wherein said electrophotographic photosensitive body is the electrophotographic photosensitive body as described in claim 1.

8. An electrophotographic apparatus comprising an image forming system provided with at least an electrophotographic photosensitive body and a cleaning member which comes into contact with the surface of said photosensitive body, wherein said electrophotographic photosensitive body is the electrophotographic photosensitive body as described in claim 1.

* * * * *